US005345739A

United States Patent [19]

Menchetti

[11] Patent Number: 5,345,739

[45] Date of Patent: Sep. 13, 1994

[54] WALLBOARD ATTACHMENT

[75] Inventor: Robert J. Menchetti, Buffalo, N.Y.

[73] Assignee: National Gypsum Company, Charlotte, N.C.

[21] Appl. No.: 71,094

[22] Filed: Jun. 4, 1993

[51] Int. Cl.[5] ..... E04B 2/00

[52] U.S. Cl. ..... 52/489.2; 52/483.1; 28/43; 28/122; 28/194

[58] Field of Search ..... 52/281, 489; 428/43, 428/122, 192, 194

[56] References Cited

U.S. PATENT DOCUMENTS

| | | | |
|---|---|---|---|
| 1,724,740 | 8/1929 | Utzman . | |
| 2,049,030 | 7/1936 | Strauss | 428/43 |
| 4,112,647 | 9/1978 | Scheid | 52/281 X |
| 4,117,644 | 10/1978 | Weinar | 52/714 |
| 4,296,580 | 10/1981 | Weinar | 52/281 |
| 4,467,578 | 8/1984 | Weinar | 52/281 |
| 4,562,102 | 12/1985 | Rabuse et al. | 428/43 |
| 4,946,732 | 8/1990 | Cohen et al. | 428/192 |
| 5,087,310 | 2/1992 | Robinette | 156/202 |
| 5,135,790 | 8/1992 | Kaplan et al. | 428/43 X |

*Primary Examiner*—Carl D. Friedman
*Assistant Examiner*—Kevin D. Wilkens
*Attorney, Agent, or Firm*—Marshall, O'Toole, Gerstein, Murray & Borun

[57] ABSTRACT

Edge protective tape, on a package consisting of two predecorated wallboards, partially adhered to the wallboard back faces, forms pockets in non-adhered areas, into which wallboard mounting clips can be inserted.

20 Claims, 2 Drawing Sheets

WALLBOARD ATTACHMENT

This invention relates to attachment of wallboard employing a novel, gapped wallboard edge tape and a metal clip for insertion therein and then for fastening to a stud.

BACKGROUND OF THE INVENTION

Predecorated wallboard is packaged for shipment by placing two such wallboards face-to-face and taping the two wallboards together with edge protective tape. The edge protective tape is applied lengthwise along the two predecorated edges, with a one-inch-wide section of the tape adhered to the back face of each board. A center, one-inch-wide section overlays and protects the predecorated edges.

Prior to use of the predecorated wallboard, the one-inch-wide center section is torn away, and the two wallboards are separated. They are then mounted by some fastening means against the face of vertical studs. This fastening means has commonly included using a bead of adhesive on the stud, affixing a metal clip to the wallboard back face or impaling a metal clip into the wallboard edge.

New and better ways or less costly ways of affixing the predecorated wallboard to the studs is always desired.

SUMMARY OF THE INVENTION

The present invention consists of a novel way of packaging predecorated wallboard involving a protective edge tape that is adhered only partially along the wallboard back face, leaving spaced, small sections unadhered, forming pockets. Small, flat metal strips are packed in the wallboard package, loosely adhered to the inside surface of the center section of the edge protective tape. The metal strips have a cross section which permits their being inserted partway into the tape pockets and held there firmly.

The predecorated wallboard can then be held against the wall studs, with the protruding metal strip exposed and located over the stud surface. Metal fasteners can then affix the protruding metal strip to the stud.

Similar metal strips, which were also packed in the wallboard package are then inserted partway into the pockets of a second wallboard where they are firmly held. The second wallboard is then mounted adjacent the first wallboard by sliding protruding portions of the metal strips behind the first wallboard.

It is an object of the present invention to provide a novel package of predecorated wallboards including packaging elements useful in mounting the wallboards on wall studs.

It is a further object of the invention to provide a novel, low cost method of mounting predecorated wallboard on wall studs.

It is a still further object to provide a novel wall of predecorated wallboard, with wallboard affixed to studs with small metal strips inserted partway into pockets in the edge tape adhered to the wallboard back face.

BRIEF DESCRIPTION OF THE DRAWINGS

These and other objects and advantages of the invention will be more readily apparent when considered in relation to the preferred embodiments as set forth in the specification and shown in the drawings in which.

DESCRIPTION OF THE PREFERRED EMBODIMENTS

Figure 1:
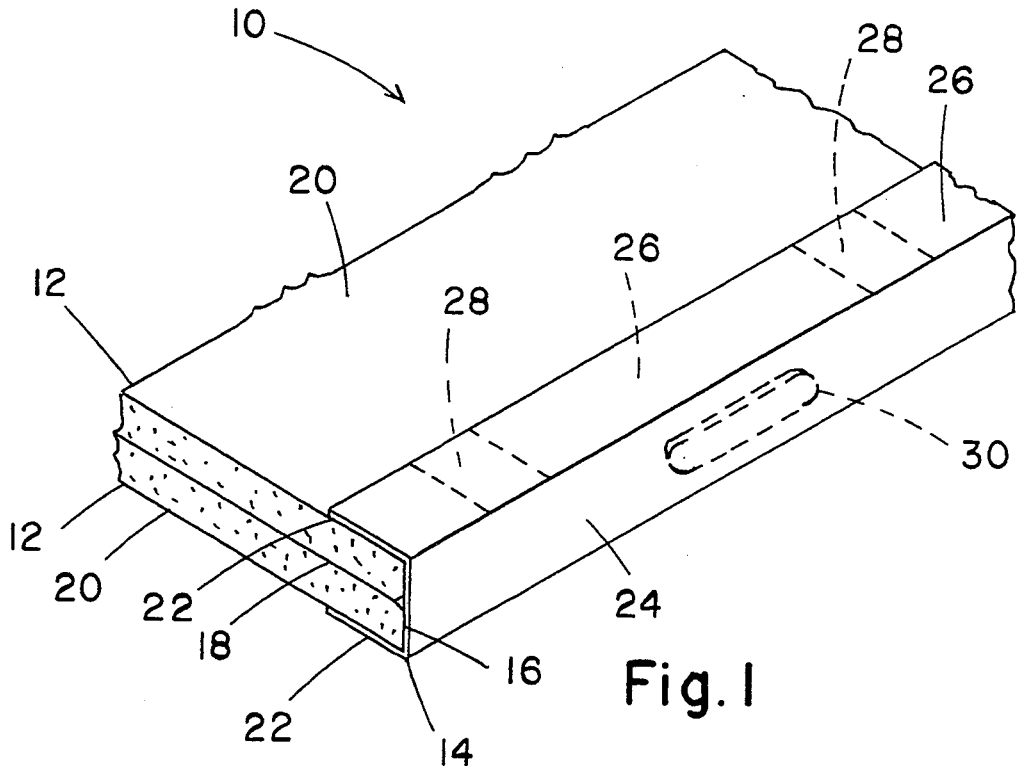
FIG. 1 is an isometric view of a corner of a package of two predecorated wallboards, embodying the invention.
Figure 2:
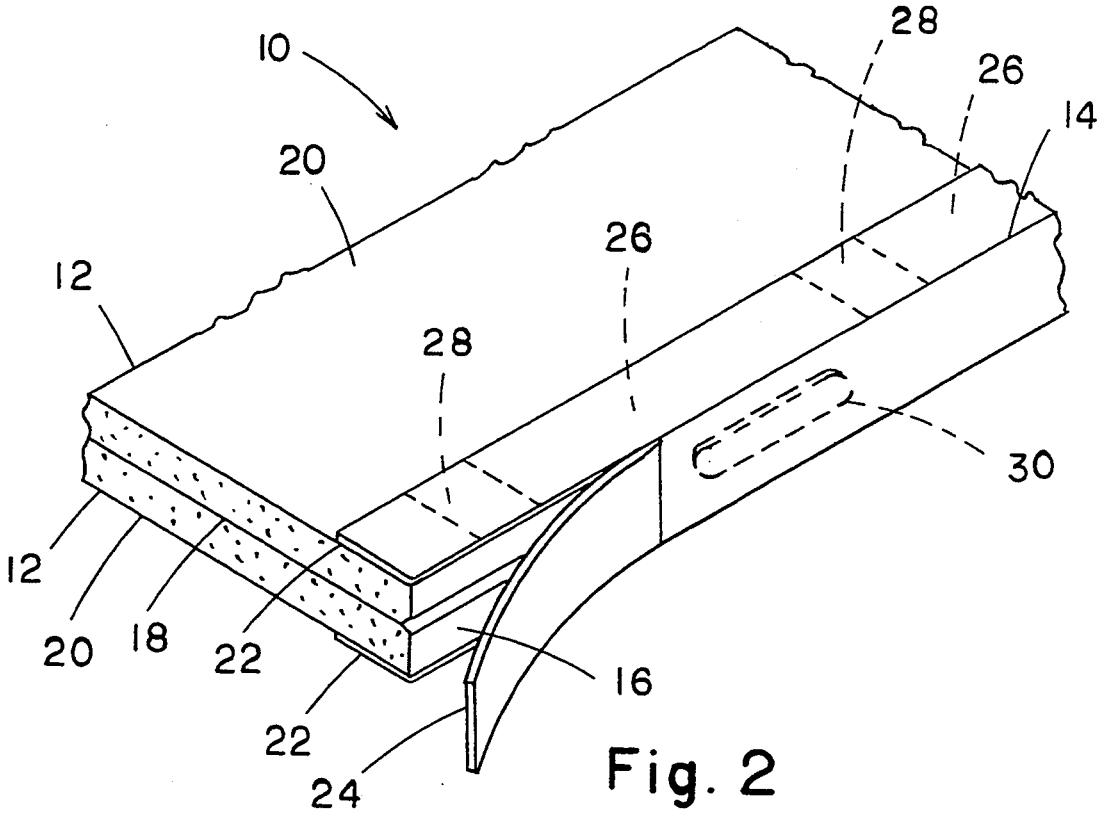
FIG. 2 is an isometric view of the corner of the package of FIG. 1, with the center section of the edge protective tape partly removed.
Figure 3:
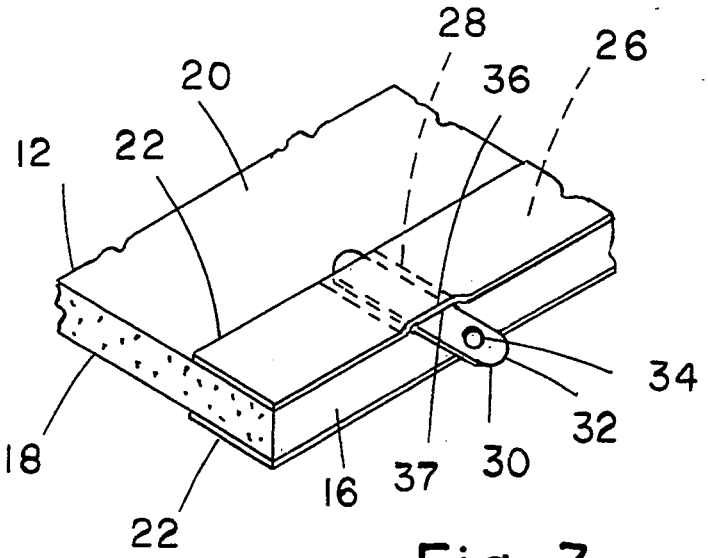
FIG. 3 is an isometric view of one of the two predecorated wallboards, with the mounting clip inserted in an edge tape pocket.
Figure 4:
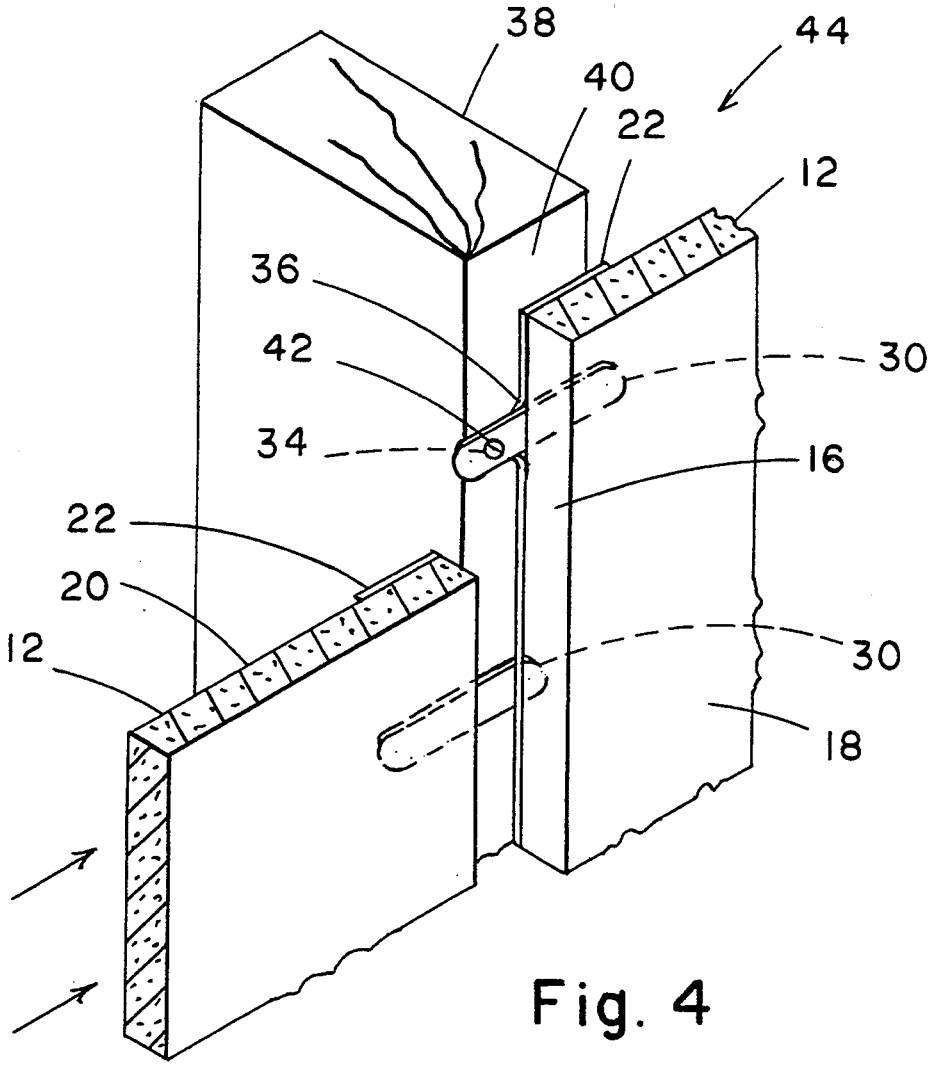
FIG. 4 is an isometric view of a first wallboard affixed by its mounting clips to a stud and a second wallboard, with its mounting clips in place, being mounted against the same stud.

Referring to FIG. 1, a corner of a package 10 of two predecorated gypsum wallboards 12, 12 is shown, with edge protective tape 14 on the side edges 16, holding the two wallboards 12, 12 together. Another identical edge protective tape (not shown) is holding the wallboards 12, 12 together on the opposite side edges (not shown) of the wallboards 12, 12 of package 10, as will be readily understood.

Each wallboard 12 includes a predecorated front face 18, predecorated side edges 16 (one side edge not shown) and a back face 20. Edge protective tape 14 is adhesively affixed, along two tape side sections 22, 22, to the wallboard back faces 20, 20. A tape center section 24 extends across the two predecorated edges 16, 16.

Of particular importance, the two tape side sections 22, 22 are adhesively affixed to back faces 20, 20 only in carefully selected adhesive areas 26, carefully selected for the reason that the non-adhesive areas 28 therebetween will always be of a width which will receive and firmly hold a board mounting clip 30, preferably packaged between the tape center section 24 and the wallboard edges 16, loosely adhered to tape 14. Clips 30 could, alternatively be sold and shipped separately.

Prior to mounting the predecorated wallboard, the tape center section 24 is torn off the package 10, leaving the two wallboards 12, 12 with the tape side sections 22, 22 still partially adhesively affixed to the wallboard back faces 20, 20, and the clips 30 now accessible. In packaging clips 30 within package 10, the clips 30 are preferably lightly adhered to the tape center section 24.

Clips 30 are merely 2-inch by ½-inch strips of sheet metal, rounded at each end 32, with a fastener hole 34 at one end.

Pockets 36 are formed between the tape side section 22 and the wallboard back face 20 at each non-adhesive area 28, with the pocket width about ½ inch, forming a pocket 36 into which the clips 30 will fit and be held tightly, resisting any accidental or unintentional movement. Approximately two pockets 36 are provided per foot of tape side section 22, however, this number of pockets 36 could vary from about six per foot to one about every two feet. All of the pockets 36 have an opening 37 directed toward the wallboard side edge 16.

To mount wallboard 12, a clip 30 is slid about halfway into every other pocket 36; in other words, about one clip 30 per foot. The wallboard 12 is then held in place against a suitable vertical support, such as vertical studs 38, with wallboard covering half the front surface 40 of stud 38 and with clip hole 34 disposed over the other half of the front surface 40. A screw 42 is screwed through hole 34 into stud 38, at each of the clips 30.

Additional clips 30 are then inserted about halfway into pockets 36 of a second wallboard 12, the second wallboard 12 is placed closely adjacent the first mounted wallboard 12, and the clips 30 in the second wallboard 12 are slid in behind the first wallboard 12, between the first wallboard 12 and the stud front surface 40. In this second wallboard the clips 30 are only inserted into every other pocket 36, about one clip 30 per foot. By providing one pocket 36 every six inches, the pockets 36 of the second wallboard 12 used will be those which result in the clips 30 being inserted behind the first wallboard 12 at locations as near to halfway between each screwed clip 30 holding the first wallboard 12. This avoids the clips 30 of the first wallboard 12 interfering with the insertion of the clips 30 of the second wallboard 12 behind the first wallboard 12.

Further construction of the wall 44, continues progressively, with clips 30 then inserted into pockets 36 on the opposite side (not shown) of the second wallboard 12, and screwed to a second stud (not shown), and a third wallboard mounted with clips 30 slid between the second wallboard and the second stud, etc.

Having completed a detailed disclosure of the preferred embodiments of my invention so that those skilled in the art may practice the same, I contemplate that variations may be made without departing from the essence of the invention or the scope of the appended claims.

I claim:

1. A wallboard comprising a front face, a back face and two side edges, and tape applied to said back face adjacent at least one of said side edges, said tape having spaced apart adhered areas thereof adhesively attached to said back face and nonadhered areas thereof free from attachment to said back face, whereby said tape is adhered to said back face in a plurality of spaced apart, adhered areas with a plurality of said nonadhered areas between said adhered areas, said nonadhered areas forming pockets between said tape and said back face, said pockets having an opening directed toward said side edge, whereby said pockets are operable to receive mounting clips therein.

2. A wallboard as defined in claim 1, wherein said wallboard has between about 1 and about 12 pockets per two feet of length.

3. A wallboard package comprising first and second wallboards, each of said wallboards being constructed as defined in claim 1, wherein each of said wallboards comprises a predecorated gypsum wallboard having a predecorated front face and a predecorated side edge, and said tape comprises a center section and first and second side sections on opposite sides of said center section, said center section of said tape extending across a side edge of said first wallboard and across a side edge of said second wallboard, said first side section being adhered to said back face of said first wallboard and said second side section being adhered to said back face of said second wallboard.

4. A wallboard package comprising wallboards as defined in claim 3, and further comprising a plurality of mounting clips, said tape holding said mounting clips within said package.

5. A wallboard package as defined in claim 4, wherein said pockets are about ½-inch wide and said clips are substantially flat strips of metal sized to be received in said pockets.

6. A wallboard package as defined in claim 4, wherein said wallboards are each about ½-inch thick and said clips are relatively flat strips of metal less than one inch wide, said clips being adhered to an inner surface of said tape.

7. The method of bundling wallboards and of constructing walls utilizing said wallboards and wallboard mounting clips, comprising placing two wallboards together in face-to-face relation to form a package, affixing said two wallboards together to form a bundle using an edge protective tape by applying said edge protective tape along two side edges of said two wallboards, and adhering said tape to spaced apart areas of the back faces of said two wallboards, pockets being formed under said tape at the portions of said back faces between said spaced apart areas moving said bundle to a wall construction site, removing the center portion of said tape to expose said two side edges, inserting wallboard mounting clips into said pockets of one of said wallboards, and affixing said clips to a suitable vertical support.

8. The method of claim 7, wherein said wallboards are predecorated wallboards with predecorated front faces facing one another and with predecorated wallboard side edges and said edge protective tape is placed over substantially all of said wallboard side edges, protecting said predecorated said edges.

9. The method of claim 7, wherein a second said wallboard is mounted adjacent said one of said wallboards by inserting said wallboard mounting clips into said pockets of said second wallboard, and placing exposed portions of said clips of said second wallboard between said one of said wallboards and said vertical support.

10. The method of claim 7, wherein said wallboard mounting clips are placed between said edge protective tape and said wallboard side edges during said packaging.

11. The method of claim 10, wherein said mounting clips are adhered to said tape in said package.

12. The method of claim 10, wherein said pockets have a width substantially equal to a width of said clips and having an opening directed toward said wallboard side edge.

13. A vertical wall comprising a fixed vertical support and a plurality of wallboards, said wallboards having a front face, a back face and two opposite side edges, an elongate, narrow, tape having spaced apart adhered areas thereof adhesively attached to nonadhered areas forming a plurality of spaced pockets between said tape and said back face, mounting clips inserted into at least some of said pockets, and fastening means affixing said mounting clips to said vertical support.

14. A vertical wall as defined in claim 13, wherein said wallboards are predecorated gypsum wallboards, said tape is an edge protective tape, said mounting clips are metal strips having a width substantially equal to a width of said pockets, and said mounting clips have holes through which metal fastening means extend and project into said fixed vertical support.

15. A vertical wall as defined in claim 13, wherein said mounting clips in pockets along one side edge of said wallboard have a portion of each said mounting clip projecting outward of said pocket and extending to in between said vertical support on a back face of an adjacent wallboard.

16. A vertical wall as defined in claim 13, wherein said pockets are located substantially evenly spaced throughout the length of said tape.

17. A vertical wall as defined in claim 16, wherein there are between about one to twelve pockets per two feet of tape.

18. A vertical wall as defined in claim 17, wherein said pockets are about ½-inch wide.

19. A vertical wall as defined in claim 17, wherein said mounting clips are metal strips.

20. A vertical wall as defined in claim 19, wherein said pockets and said clips are both substantially the same width.

* * * * *

UNITED STATES PATENT AND TRADEMARK OFFICE

CERTIFICATE OF CORRECTION

PATENT NO. : 5,345,739

DATED : September 13, 1994

INVENTOR(S) : Robert J. MENCHETTI

It is certified that error appears in the above-identified patent and that said Letters Patent is hereby corrected as shown below:

COLUMN 4, LINE 48:

In Claim 13, the line reading "areas thereof adhesively attached to nonadhered areas" should read --areas thereof adhesively attached to said back face adjacent each said side edge and nonadhered areas thereof free from attachment to said back face, said nonadhered areas--.

Signed and Sealed this

Twenty-seventh Day of December, 1994

*Attest:*

Bruce Lehman

BRUCE LEHMAN

*Attesting Officer*

*Commissioner of Patents and Trademarks*